United States Patent [19]

Cernauskas et al.

[11] 4,072,127

[45] Feb. 7, 1978

[54] INSIDE STRIPE BY INTERMITTENT EXTERIOR SPRAY GUNS

[75] Inventors: Larry V. Cernauskas, Chicago; Harry B. Foss, Oak Lawn, both of Ill.

[73] Assignee: The Continental Group, Inc., New York, N.Y.

[21] Appl. No.: 724,234

[22] Filed: Sept. 17, 1976

Related U.S. Application Data

[62] Division of Ser. No. 461,838, April 18, 1974, Pat. No. 3,995,075.

[51] Int. Cl.[2] ..... B05C 7/02

[52] U.S. Cl. ..... 118/2; 118/317

[58] Field of Search ..... 134/54, 55, 170; 118/317, 318, 2, 302; 228/43; 427/287, 236, 239

[56] References Cited

U.S. PATENT DOCUMENTS

| | | | |
|---|---|---|---|
| 1,829,661 | 10/1931 | Krautzberger | 118/302 X |
| 2,763,575 | 9/1956 | Bede | 118/302 X |
| 2,798,456 | 7/1957 | Pearson | 118/313 X |
| 3,526,027 | 9/1970 | Manuel et al. | 118/317 X |
| 3,726,711 | 4/1973 | Hogstrom | 427/233 |
| 3,778,292 | 12/1973 | Rood et al. | 427/239 X |

*Primary Examiner*—John P. McIntosh

*Attorney, Agent, or Firm*—Diller, Brown, Ramik & Wight

[57] ABSTRACT

Methods and apparatus for coating the interior side seam of can bodies. The can bodies proceed down a line in serial order with end toward end and uniformly spaced from each other down the line extending from a can body side seaming machine. An airless spray coating is shot into each can body from the front and the rear to leave a coating of plastic along the interior side seam of a soldered can body.

8 Claims, 5 Drawing Figures

INSIDE STRIPE BY INTERMITTENT EXTERIOR SPRAY GUNS

This is a division of application Ser. No. 461,838, filed Apr. 18, 1974, now U.S. Pat. No. 3,995,075 granted Nov. 30, 1976.

This invention relates to methods and apparatus for coating the interior of a cylindrical object such as a can body as it proceeds down a line. This invention applies particularly to improved methods and apparatus for applying a coating through the ends to the interior side seam surface of a cylindrical object as it proceeds in series fashion down a line with a small spacing between the objects.

Various apparatuses and methods have been used for striping the inside surface of a side seam of a can body. One such apparatus is shown in the patent to P. E. Pearson, U.S. Pat. No. 2,798,456, July 9, 1957 and assigned to Continental Can Company. This apparatus utilizes a spray head which moves rapidly in and out of each of a series of can bodies as the can bodies are proceeding down a line with the can bodies in end to end relationship and uniformly spaced from each other.

Another apparatus for internally coating can bodies as well as can body seams is found in the patent to J. C. Brichta, et al, U.S. Pat. No. 3,230,927 issued Jan. 25, 1966 and assigned to Continental Can Company. Brichta's shows a spray head which is adapted to coat the can body interior. This patent describes the use of its film forming head to coat the interior of a can body or a can body seam after solder has been applied to the side seam of a can body.

It is an object of this invention to provide a coating to the interior of a side seam of a can body or other cylindrical object as it proceeds in the direction of its long axis down a can line.

It is a further object of this invention to provide front and rear spray guns for spraying a coating to the interior surface of each of a sequence of cylindrical containers as they are proceeding one after the other down a can line with a space between the ends.

It is an object of this invention to provide a method and apparatus for coating the interior of the side seam of a can body by spraying from outside the can body line through the interval between can bodies when the length of the can body side seams are oriented in the direction of can body motion.

Other objects and utilizations will become apparent from consideration of the following:

Figure 1:
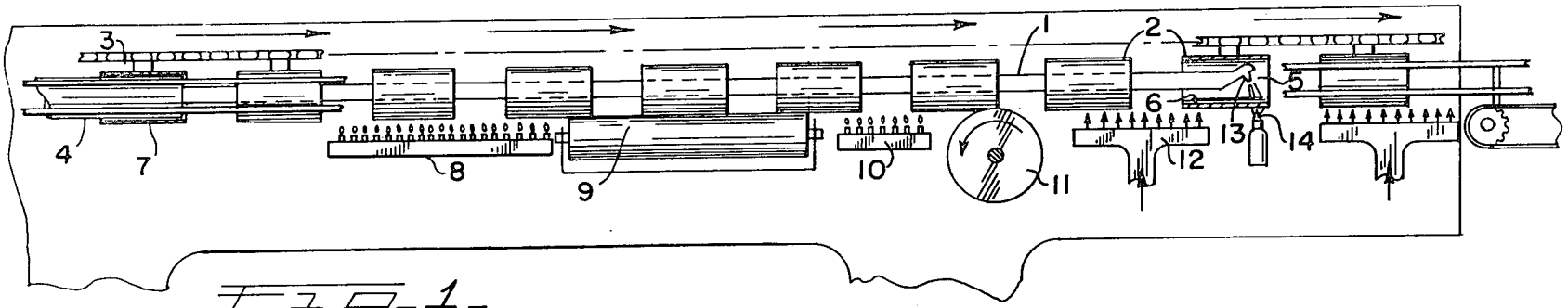
FIG. 1 is a schematic drawing of the tube system of applying an inside side stripe to a side seam of a container body.

In the past a tube 1 (FIG. 1) has been used to coat the soldered side seam of a can body 2 with a coating material. In this showing the can body 3 is formed around a stub horn 4 to the left in the drawing. A long tube 1 extends down through the center of the series of can bodies. The coating material 5 passes through the inside of this tube to the end of the tube where it is jetted onto the interior surface 6 of the side seam. The can bodies 3 are formed but not soldered as they come off the stub horn 4. These can bodies have interlocked edges and form a tubular configuration. The side seam 7 of the can is formed downwardly and as the can passes along it is heated by the presolder burners 8. Solder is then applied to the side seam opening by a solder roll 9. After the solder has been applied to the side seam opening, it then passes to the pre-wiper burners 10. The pre-wiper burners heat the excess solder on the exterior surface of the side seam of the can body so that is may be wiped by a solder wiper roller 11. The solder that filled the locked side seam forms a seal against passage of material into or out of the can through the side seam. As the can continues in its path a cooling stream is jetted from an orifice to flow over the can side seam to cool it to a temperature appropriate to the coating material to be applied to the can body. When the can body is cooled sufficiently a coating stripe is placed on the exterior by exterior nozzle 14 and on the interior from tube nozzle 13 to protect the side seam from the elements and packed product respectively. While the exterior stripe is applied in the conventional manner the interior stripe is applied by material fed through the elongate inside stripe tube 1 and applied downwardly onto the side seam. In this situation the material in tube 1 is kept in a more or less continuous flow through the interior tube. A catch ring such as that shown in Brichta,. U.S. Pat. No. 3,230,927 may be used in this combination to catch the material coming through elongate inside stripe tube 1 during the period when no can is present adjacent the spray head of the inside stripe tube. After being sprayed the can is still hot enough to cause the inside stripe material to harden and to adhere to the can and the can is now cooled and the stripe material is ready for further operations. The term "harden" as used herein is intended to cover drying, curing or fusing.

Figure 2:
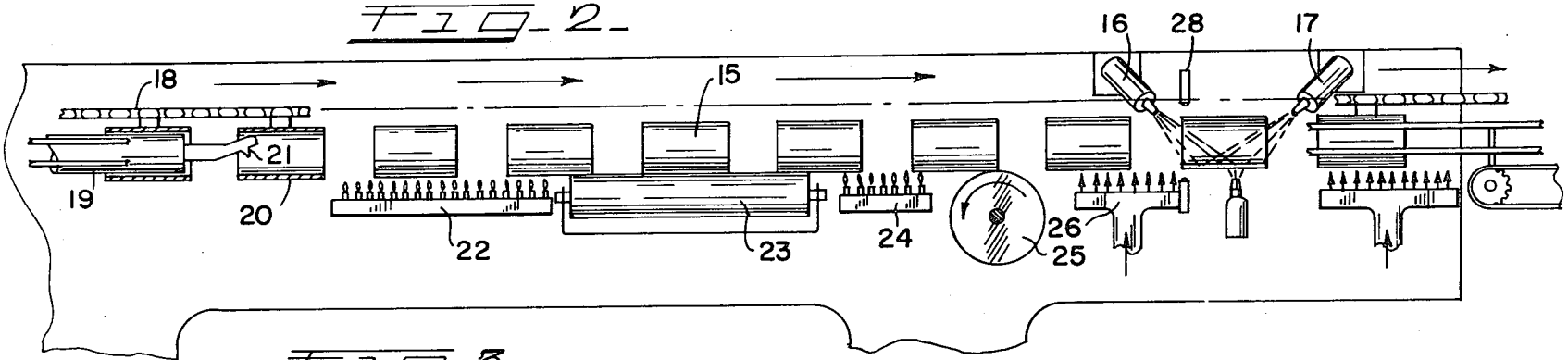
FIG. 2 is a schematic drawing of the external gun method of applying an inside side stripe to a soldered side seam of a container body.

The system for coating a soldered can 15 with an inside stripe by the use of intermittent external spray guns 16,17 is shown in FIG. 2. In the embodiment shown in FIG. 2 a can body 18 is formed about a stub horn 19 with the edges interlocked so as to have a tubular configuration. It is then bumped to flatten the interlock. After these operations are performed, it may be desirable to coat the interior of each can body with a pre-solder stripe as the can proceeds down the line. The interlocked seam 20 of the can body is on the lower part of the can body. After a pre-solder stripe has been applied by nozzle 21 to the inside of the interlocked seam of the can body, the interlocked seam is passed over pre-solder burners 22. The pre-solder stripe prevents solder from contaminating the interior of the can body. The pre-solder burners 22 heat up the interlocked seam of the can body. In the next operation solder is applied to the opening of the seam. This is done by a solder roll 23 which is in continuous rotary motion. The can side seam is now passed over the pre-wiper burners 24. These burners make the solder somewhat more liquid and the excess solder is then wiped by a solder wiper brush 25 and presents a smooth exterior surface to the cooling blast which subsequently is directed upon it from a cooling jet 26. The cooling blast cools the side seam to the point that an outside stripe may be placed over the side seam and an inside stripe is placed onto the inside seam from external guns 16,17. Guns 16,17 jet liquid coating material for very short periods of time. A further cooling jet 27 may be placed in the line after the guns 16,17. The operation of the intermittent external guns 16,17 is as follows:

As the can bodies proceed down the can line in an end to end relationship they are more or less uniformly spaced from each other. The side seam is on the lower portion of each can and its length points in the direction of motion of each can. As the can bodies proceed in this fashion down the can line they trip a detector 28 (FIG. 4) of some sort such as a photoelectric eye. Detector 28 is located along the path of the can body line at such a point that the passage of the can body causes the detector 28 to transmit a signal. The signal is conducted to a control unit 29. A control unit such as the internal control units for example, the Dual Coding Control K7360, sold by INSTRUMENTS AND CONTROL SYSTEMS, INC. of Addison, Illinois is sufficient for this purpose. The control unit has a first delay adjustment 30, a first duration adjustment 31, a second delay adjustment 32 and a second duration adjustment 33 as well as an on-off switch 34, a test button 35 and an operate or test switch 36. The output from a first terminal 37 is controlled by the first duration and delay adjustments 30,31 and the output from a second terminal 38 is controlled by the second duration and delay adjustments. Third and fourth terminals 39,40 are provided for the detector circuit. The control unit 29 is powered by a 110 volt, A.C. source. (Now shown.)

In practice the detector is usually a photoelectric cell 28 with the passage of the can body cutting a light beam from light source 41 and actuating the control sequence. A proximity switch may also be used. The detector 28 is located upstream to allow for timing delays inherent in the circuit 29, air pressure build up and the nozzle to can body surface spray travel time. Nozzles 42,43 are located at about the same distance from the surface to be sprayed.

In operation a signal is sent from the photocell 28 to the control circuit 29. After suitable delay, individual control signals are sent from the first and second output terminals 37,38 to the spray gun control solenoids 44,45 and each solenoid opens a valve in the corresponding spray gun 46,47 to allow the coating material under high pressure to be sprayed from nozzles 42,43 onto the interior surface of the can body. Appropriate solenoid valves such as Valve E23NK90CM 24 volt DC, may be purchased from Peter Paul Electronics Company of New Britain, Connecticut, and appropriate high pressure spray guns such as the gun Model A7A may be purchased from NORDSON COMPANY of Amhurst, Ohio. When the can body is in the space between the external spray guns 46,47 the spray pattern from each of the external guns does not impinge upon the exterior of the can body. The external gun continues to spray for a period of from ten to more than two hundred milliseconds.

Figure 4:
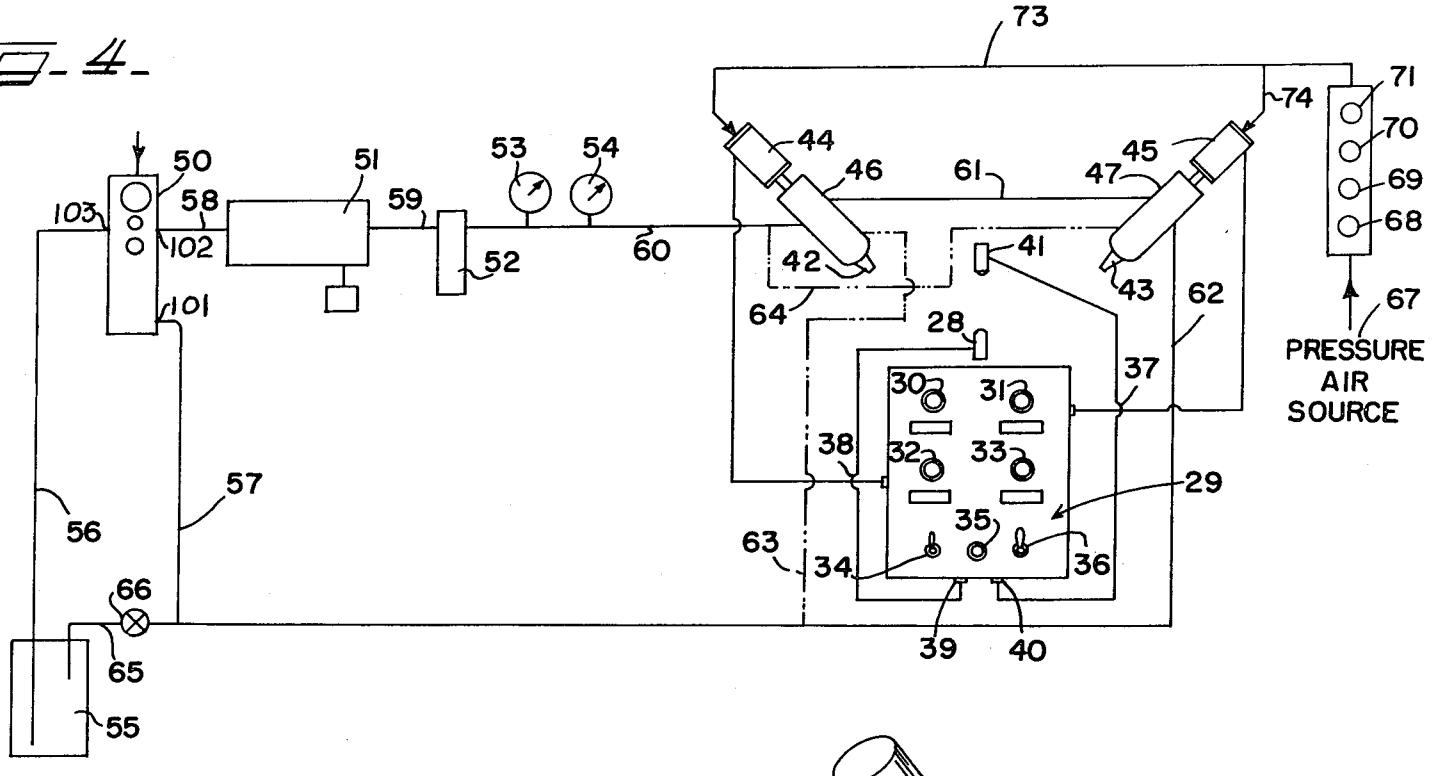
FIG. 4 is a schematic drawing of an apparatus of my invention.

The spray system shown in FIG. 4 has two component systems. One system is the control system having light source 41, photocell 28, time interval control unit 29, and solenoids 44,45. A second system is the liquid pressure system. The liquid pressure system has a first circulating circuit with the liquid in constant circulation and a second feed circuit. The circulating circuit has a high pressure pump 50 having circulating port 101 and feed port 103, or any pressure producing device, a heater 51, a filter 52, a temperature gauge 53, a pressure gauge 54, one or more spray guns 45,46, and a supply container 55 for supplying liquid. These elements are hydraulically connected by suitable conduits 56-65. The heater 51, filter 52, and guns 46,47 each have an entrance and an exit port. When a solenoid is electrically actuated a valve in the spray gun opens and the liquid in the circulating circuit which is under high pressure sprays through the spray tip of the spray gun onto the interior surface of the can body.

The spray guns are shown as connected in series to the spray source. The series arrangement, conduits 60,61,62 has the practical advantage of saving piping. Alternatively, the phantom lines show a parallel feed arrangement, conduits 60,63,64. In this arrangement the series conduit 61 connecting the guns is eliminated. An advantage of the parallel feed is that both guns 46,47 are fed equally. In the series arrangement the upstream gun 46 may starve the downstream gun 47 depending on volume of spray, pressure and other factors.

In operation the circulating system has a pressure of about 200 to one thousand pounds per square inch. The heaters 51 keep the temperature of the liquid at about 100°-180° Fahrenheit, to reduce viscosity, and to ensure uniform flow from spray guns 46,47 for any specific increment of time. An on-off valve 66 is placed in the conduit 65 between the circulating system and the supply container 55. This conduit 65 is used to drain the system.

The air is delivered from a source 67 under a pressure of about 50-60 pounds per square inch. When the solenoid valve is open the pressured air from the spray gun escapes through the solenoid into the surrounding air. When the solenoid is actuated and is closed then the pressured air moves into the spray gun and causes the valve inside the spray gun to open to allow the liquid to pass through the nozzle at the spray tip. The pressure air passes from air source 67 through a filter 68 to strain out dirt, a pressure regular 69 to adjust the air pressure and a lubricator 70 to introduce oil droplets into the pressure air so that lubrication is maintained in the valve in the solenoid and the spray gun. A pressure gauge 71 may be connected to conduit 72 to allow visual indication of the pressure level. Conduit 73 extends from the pressure source to solenoid 44 and conduit 74 connects solenoid 45 to pressure conduit 73.

As shown in FIG. 4 the output terminals 37,38 of the internal control unit 29 are connected to one solenoid 45,44 each. If more spray guns are to be used one internal control unit may be used to control several guns by parallel circuits.

In the event that it is desired to spray the inside stripe using intermittent external guns on a welded or cemented seam body a somewhat different apparatus is used and a somewhat different sequence of events takes place. In this embodiment (FIG. 3) a can body 80 with a welded side seam 81, for example, comes from the stub horn 82 and passes down the can line in its usual orientation. Thus the side seam 81 is downward and the orientation of the can body 80 is such that it is end to end with a more or less uniform space between can bodies 80,82.

The can bodies move along over a sequence of cooling vents 83,84. A spray gun or guns 85,86 are mounted at the point where the side seam has cooled to a temperature suitable for the application of an inside stripe using intermittent external guns. A detector 87,88 and one or more external guns 85,86 operate in a similar fashion to that described in regard to FIG. 2. That is to say, the external gun 85,86 fires for a period of from ten to more than two hundred milli seconds to coat the interior of the can body 89 with an interior side stripe 90. After being sprayed internally the can body side seam 81 may be heated up by means of burners 92 located underneath the side seam. An outside side stripe is then sprayed onto the exterior surface 93 of the can side seam from an exterior nozzle 94 and the can proceeds to the next operation.

Alternatively, after being coated on its inside the can body may be cooled and then sprayed on its outside. As pointed out in the specification above multiple coats may be applied internally or may be applied externally if desired.

In the descriptions above relating to internal side striping, applicant uses the apparatus shown in the schematic of FIG. 4 for his control circuit 29 and control system to limit the duration of the time that the spray comes from each spray gun. Each spray gun is made operative to spray only when it is pointed through the gap between cans. The control unit for each spray gun is adjusted to cause the gun to operate for about the same time interval. It is possible to mount several guns about the can line. It is also possible to set the spray guns or guns for different intervals so that one spray gun may be operated only, two spray guns may be operated, all guns may be operated synchronously, or, depending upon their spacing, the guns may be operated one after the other. With the type of timing device which is used, these guns may be mounted so as to spray from a multiplicity of guns onto the can side seam or to spray the entire interior of the can at the same time that the side seam is being sprayed. The detector system used in this apparatus may be a light source and a photocell. A light source and photocell may be mounted on opposite sides of the can line so that as a can body proceeds down the can line it interrupts the light beam which goes from the light source to the photocell. The use of this system allows a sharp response to the movement of the can body. As pointed out in the preceeding description, the particular time interval controller used in this application has provision for delaying the output signal and for adjusting the duration of this output signal. Provision is also incorporated for delaying a second output signal and the duration of that signal in accordance with knobs mounted on the face of the timer.

The side seam striping technique is particularly useful for the interior of certain types of bodies which do not require a full coating around the interior of the can. The coating along the side seam area protects the contents of the can from contact with metal or any material resulting from soldering, welding, or the like in that area. Luncheon meat, shrimp and crab, cranberries, ham, certain soft drinks and juices, fruits and vegetables and non-carbonated juices may be put into cans which have had the interior side seam treatment described above.

One or two guns may be used depending on the dimensions of the can body and can sections. For example, a single gun spraying into one end would be practical for a eighty-seven and three tenths by forty-six millimeter body while a sixty-two and seven tenths by one hundred eighteen and three tenths millimeter can body could require two guns each spraying an opposite end. The gun or guns may be oriented in a direction to spray into either the lead or trail end of the can body. The spray gun is oriented at an acute angle if the can body is long with a small diameter. The spray gun is at a wider angle if the can body is short with a large diameter. It is also possible to use multiple applications of striping material at several additional locations on the side seamer to further enhance the product protection.

The exact duration of time through which the external guns operate to release coating material is dependant upon factors such as the amount of coating material needed on the can body interior, the speed of the can line, the number of external guns mounted about the can line, the area to be coated, and other factors.

The table below gives examples of settings that have been used on an experimental basis:

| Can size | 307 × 113 | 202 × 214 | 207.5 × 410.5 | 202 × 314 × 304 | 211 × 413 | 300 × 407 |
|---|---|---|---|---|---|---|
| Line Speed | 420 | 400 | 510 | 235 | 495 | 440 |
| Space Between Bodies | 1-13/16 | 3-2/16 | 2-11/16 | 4-2/16 | 2-9/16 | 2-15/16 |
| Spray Angle in Vertical Plane Of Side View From Horizontal | 53° | 40 | 38° | 53° | 33° | 40° |
| Spray Angle in Vertical Plane Of End View From Horizontal | 63° | 55 | 60° | 84° | 56° | 60° |
| Spray Duration Milliseconds | 28 | 50 | 21 | 65 | 25 | 14 |

As the can body proceeds away from the place where it had been soldered, welded or otherwise highly heated, it cools through time. This cooling effect may be supplemented by a cooling blast of air being directed onto the hot side seam. In any case, the spray gun can be placed at any point along the path of the can body.

There would be difficulty in applying more than one type of coating material using the apparatus for Brichta, et al, U.S. Pat. No. 3,230,927. Referring again to FIGS. 2 and 3 of the instant application the can side seam is at its hottest just as it leaves the pre-wiper burner of FIG. 2 and as it leaves the welding machine at FIG. 3. Different coating materials having different characteristics may be sprayed onto the inside of the can at a different point in the path of the can since the can is cooler the further away from the sealing operation that is gets. If it is desired to double coat with the same material then the two coating sequences should be placed fairly close together or possibly the can may be reheated before going to the second coating operation.

Figure 3:
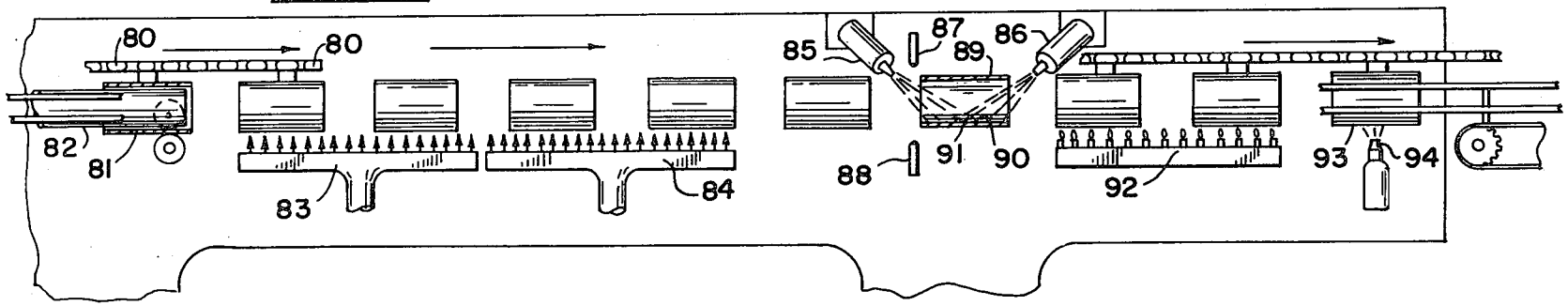
FIG. 3 is a schematic drawing of the external gun method of applying an inside stripe to a welded or cemented side seam of a container body.
Figure 5:
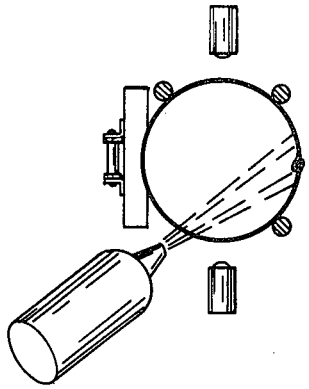
FIG. 5 is a drawing showing an end view of the relationship of can body, spray gun, rails and drive chain.

The relationship of spray gun, detecting device, support rails, and can holding and transport chain is shown in FIG. 5. The spray gun is positioned above and to the side. This avoids spray falling onto the can holding and transport chain. A section of a rail is deleted at this point to allow the spray to jet onto the bottom seam of the can body. The light source and photocell are shown mounted laterally of the can transport line rather than in a vertical plane as shown in FIGS. 2 and 3.

Several coats of different material may be applied to a single can body seam. As a can body proceeds down the can line away from the soldering or welding point the side seam gradually cools. Different types of coating material harden at different temperatures to form a coating adhering to the inside of the can body.

By placing spray guns at different points of travel of the can body different coating materials may be sprayed onto the interior or exterior surfaces of the can body to form a multilayered coating. For example, as a first coat a solvent based epoxy material may be sprayed onto the interior of the side seam when the side seam is at a temperature of about 400° Fahrenheit, then when the side seam temperature has fallen to about 300°-350° Fahrenheit a solvent based vinyl material may by sprayed into the can body from a spray gun further down the line and possibly a wax may be sprayed in when the seam temperature has fallen to the range of about 150°-200° Fahrenheit. At these temperatures the solvent evaporates very rapidly leaving the coating material to harden and form a covering over the side seam. It is not necessary to turn the can or in any way interrupt its steady forward progress.

The apparatus and method of applicant's invention have at least the following advantages:

Mechanical simplicity, the can body proceeds through the coating operation without turning, stopping or any other interruption of flow, low possibility of clogging, controlled starting and cut-off with adjustable duration of spray, accessiblility of spray apparatus for repair, versatility in placement of the spray guns along the can body line, and, the use of a plurality of coating stations located exteriorly of the can body with possible different coating materials at each station to provide multiple applications of coating material to a can body because of progressive cooling of the can body and can side seam.

The foregoing is a description of an illustrative embodiment of the invention and it is applicant's intention in the appended claims to cover all forms which fall within the scope of the invention.

We claim:

1. An apparatus for spraying the inside of the can bodies having side seams and which can bodies pass end to end down a can body line from a can body side seamer with each can body spaced a distance from each other can body, said apparatus comprising in combination with said can body line;

a detector positioned alongside said can body line for sensing the presence of a can body as it passes, spray means fixedly positioned alongside said can body line out of the path of can bodies passing therealong and directed towards said can body line downstream thereof for successively spraying side stripe material through the space between can bodies into an open end of each can body moving along said can body line and unto the interior of moving can bodies, and control means connected to said detector and to said spray means for causing said spray means to intermittently spray side striping material beginning at a time each can body has passed said spray means and for a period of time after each can body has passed said spray means but during such time as the interior of the respective can body is in the path of spray from said spray means.

2. An apparatus as set forth in claim 1 in which said detector comprises:

a light source set to one side of the path of travel of said can bodies along said can body line.

a photocell having an output terminal and mounted in opposition to said light source whereby light passes from said light source through the space between can bodies to generate an electrical signal from said output terminal.

3. An apparatus as set forth in claim 2 in which said control means comprises;

electrical control means for causing said spray means to spray material into each can body for a period of at least ten milliseconds during the time each can body is passing the spray path of said spray means, first electrical connecting means connecting said photocell output terminal to said control means, second electrical connecting means connecting said control means to each said spray means for starting and stopping the passage of spray material through said spray means into the interior of each can body.

4. An apparatus as set forth in claim 1 wherein:

said spray means is in the form of a forwardly directed first gun, and there is a rearwardly directed second gun for spraying side striping material into a leading end of each can body.

5. An apparatus as set forth in claim 4 wherein said control means also controls the simultaneous operation of said second gun.

6. An apparatus as set forth in claim 5 wherein said first and second guns are spaced along said can body line a distance proper for spraying side striping material simultaneously into the same can body.

7. An apparatus as set forth in claim 6 together with pressure means for supplying side striping material under pressure to said guns at the same time.

8. An apparatus as set forth in claim 7 in which said pressure means comprises;

a high pressure pump having a circulating orifice, an exit orifice and a feed orifice, means for heating said coating material and having an entrance orifice and an exit orifice, first conduit means for connecting said exit orifice of said pump to said entrance orifice of said heating means, means for filtering said coating material to filter out any foreign particles and having an entrance orifice and an exit orifice, second conduit means connecting the exit orifice of said heating means with the entrance orifice of said filter, and entrance orifice in said first gun, third conduit means connecting said exit orifice of said filter to an entrance orifice of said first gun, an exit orifice in said first gun, an entrance orifice in said second gun, fourth conduit means connecting said exit orifice in said first spray gun to an entrance orifice in said second gun, an exit orifice in said second gun, fifth conduit means connecting said exit orifice in said second gun to said circulating orifice in said pump whereby a closed circulating circuit is formed from said pump to said heater to said first gun to said second gun and back to said pump, a sixth conduit means connected to said fifth conduit means for draining said circulating circuit, a coating material supply source, seventh conduit means connecting said coating material supply to said feed orifice whereby as coating material is jetted from said first and second guns coating material is replaced into said circulating circuit through said seventh conduit and said pump.

* * * * *